United States Patent [19]

Abe et al.

[11] 4,431,728

[45] Feb. 14, 1984

[54] SILVER HALIDE PHOTOGRAPHIC LIGHT-SENSITIVE MATERIAL

[75] Inventors: Takao Abe; Tatsuhiko Kobayashi, both of Hino, Japan

[73] Assignee: Konishiroku Photo Industry Co., Ltd., Tokyo, Japan

[21] Appl. No.: 386,803

[22] Filed: Jun. 9, 1982

[30] Foreign Application Priority Data

Jun. 19, 1981 [JP] Japan ..... 56-95558

[51] Int. Cl.[3] ..... G03C 7/26

[52] U.S. Cl. ..... 430/544; 430/217; 430/218; 430/223; 430/559; 430/562; 430/957; 430/958

[58] Field of Search ..... 430/217, 218, 223, 544, 430/558, 562, 957, 958, 559

[56] References Cited

U.S. PATENT DOCUMENTS 3,227,554 1/1966 Barr et al. ..... 430/382
4,139,383 2/1979 Odenwalder et al. ..... 430/223
4,149,892 4/1979 Deguchi et al. ..... 430/223
4,179,291 12/1979 Vetter et al. ..... 430/958
4,242,435 12/1980 Puschel et al. ..... 430/562

*Primary Examiner*—J. Travis Brown
*Attorney, Agent, or Firm*—Frishauf, Holtz, Goodman & Woodard

[57] ABSTRACT

There is disclosed a silver halide photographic light-sensitive material which comprises a support, a combination of an unfogged surface latent image type silver halide photographic emulsion and a material which is non-diffusible under alkali conditions and which is capable of releasing a diffusible development inhibitor or a precursor thereof as a result of cross oxidation with an oxidized product of a photographic developing agent; and a combination of an internal latent image type silver halide photographic emulsion whose silver halide grains contain therein, prior to development, fog nuclei and a dye image-forming material which is initially non-diffusible under alkaline conditions but which is capable of releasing a diffusible dye or a precursor thereof as a result of being oxidized by the oxidized product of said photographic developing agent.

22 Claims, No Drawings

SILVER HALIDE PHOTOGRAPHIC LIGHT-SENSITIVE MATERIAL

The present invention relates to a positive image-forming silver halide photographic light-sensitive material, and more particularly to a silver halide photographic light-sensitive material for the formation of a color positive image by use of an unfogged surface latent image type silver halide photographic emulsion.

As a silver halide photographic light-sensitive material or a silver halide photographic element that uses an unfogged surface latent image type silver halide photographic emulsion (hereinafter referred to as negative type emulsion), there have been known various ones such as those described below which may be discussed, classifying them broadly into two types according to functions of those dye image forming materials used in combination with negative type emulsions. The first type is of the combination of a negative type emulsion with a dye-forming material capable of releasing a diffusible dye component as the reversed function of the development of a silver halide, i.e., a diffusible dye component from the area where the silver halide have not been developed, while the second type is of the combination of a negative type emulsion with a dye-forming material capable of releasing a diffusible dye component as the function of the development of a silver halide, i.e., a diffusible dye component from the area where the silver halide have been developed, said dye component being a dye or a dye precursor. The term "diffusible" or "diffusibility" used herein is synonymous with that commonly used among those in the art, which means being movable under an alkaline condition in any photographic light-sensitive material-composing layers containing a binder such as gelatin. Term "nondiffusible" or nondiffusibility" means being substantially nonmovable under the same condition.

Examples of the first type are first given below: One of the examples is a photographic light-sensitive material which applies a combined use of a negative type emulsion with the so-called dye developer as described in U.S. Pat. No. 2,983,606.

The dye developer is a compound having in one molecule thereof both a dye portion or a precursor portion thereof and a developer portion or a precursor portion thereof, and is diffusible under an alkaline condition, but becomes nondiffusible where the development of a silver halide has taken place. In this case, therefore, a distribution of a diffusible color developer itself occurs as the reversed function of the development of the silver halide, which differs from the release of a diffusible dye or the like, but in a broader sense, it may be considered to belong to the first type. The image-forming material, like the dye developer, diffusible in itself and becoming nondiffusible as the result of silver halide development, when used in a photographic light-sensitive material or in a photographic element, has the disadvantage that in a multicolor light-sensitive material, such a dye image-forming material diffuses toward the adjacent layers early before the development of the silver halide, possibly producing a cause of deteriorating the color reproduction, while where diffusing after the development, because it still has a reactivity thereof, it reacts in a different layer, also possibly deteriorating the photographic density.

Another example of the first type is the use of a dye image forming material which is nondiffusible in itself under an alkaline condition and capable of releasing a diffusible dye or a precursor thereof as the reversed function of the development of a silver halide. When the dye image-forming material in this case is oxidized, the releasing rate of the dye or the precursor therefrom becomes markedly lowered, thus effecting no release thereof. Those dye image-forming materials having such a nature are disclosed in Japanese Patent Publication Open to Public Inspection (hereinafter referred to as Japanese Patent O.P.I. Publication) Nos. 111628/1974, 63618/1976, 69033/1978 and 88054/1980, U.S. Pat. Nos. 4,199,354, 3,980,479 and 4,108,850, and West German Patent No. 26,231,596, and the like. However, a photographic light-sensitive material that uses such a dye image-forming material in combination with a negative type emulsion has the disadvantage that it is unable to produce any satisfactory image quality due to the high minimum density (D min) thereof. The image-forming material is to be oxidized by the oxide of the developing agent produced by the development of a silver halide in the area corresponding to the D min to thereby release substantially no dye nor precursor thereof, but actually prior to being oxidized in this process, the material releases a slight amount of the dye or the precursor thereof which is then normally fixed to an image receiving layer or the like to contribute to an image formation, thus increasing the D min.

A further example of the first type is the use of a dye image-forming material that is in itself nondiffusible under an alkaline condition and releases substantially no diffusible dye or the precursor thereof in the condition as it is, but when reduced, it becomes able to release a diffusible dye or the precursor thereof. Such dye image forming materials are described in, e.g., Japanese Patent O.P.I. Publication Nos. 110827/1978, 110828/1978, 53330/1980 and 130927/1979, and Japanese Patent Application No. 183573/1980, and the like. In order to prepare a positive image-forming photographic light-sensitive material, using a dye image-forming material disclosed in these publications together with a negative type emulsion, it is necessary to use together with the above dye image-forming material a material having such a nature that is capable of reducing the dye image forming material under an alkaline condition and becomes inactive in the area where the development of the silver halide has taken place. However, the reaction system during the course until releasing a diffusible dye or the precursor thereof is complicated and difficult to be controlled.

Secondly, examples of the second type are discussed below: As has been mentioned, the second type is of the use of a dye image-forming material having the nature that is capable of releasing a diffusible dye or the precursor thereof from the area where the development of a silver halide has taken place and releases substantially no dye nor precursor thereof from the area where no development of the silver halide has occurred. Accordingly, if an image is produced by use of the dye that has been released as the function of the silver halide development from the combination of such a nature-having dye image forming material with a negative type emulsion, the image thus to be obtained is a negative image. In order to obtain a positive image from the system of such a combination, there have been various ideas such as described in French Patent No. 2,414,745 and British Pat. No. 2,019,594, which are such that after a dye has been released as the function of the development of a silver halide the dye image-forming material still remaining as the reversed function is used to form a positive image. At this time, if a positive image is formed in the area where the dye image-forming material remains the developed silver interrupts the view of the image. In order to remove this interruption, a bleach or fixing treatment is then required. On the other hand, from the remaining dye image-forming material the dye or the precursor thereof may be again released to be transferred onto an image receiving layer to thereby form a positive image. This process requires no removal of the developed silver but requires a procedure to again release the diffusible dye or the precursor thereof. The necessity of complicated procedure to obtain a desired image is a large disadvantage.

Another example of the second type is what is described in, e.g., Japanese Patent O.P.I. Publication No. 106456/1980. This is a combined use of a competitive oxidizable material with a dye image-forming and negative type emulsion, and requires at least two rounds of developing process until the obtaining of a final positive image, so that it also has the disadvantage, similar to the preceding example, that not less than two rounds of developing process must be conducted.

A further example of the second type is a photographic light-sensitive material that uses the combination of (a) a light-sensitive silver halide emulsion, (b) a compound capable of reacting with the oxidized product of a developing agent to thereby release a development inhibitor, (c) an insoluble salt-containing emulsion that may be developed without being exposed to light, and (d) a compound capable of reacting with the oxidized product of the developing agent to thereby release a diffusible dye, as described in, e.g., Japanese Patent Examined Publication No. 21778/1968, U.S. Pat. Nos. 3,148,062 and 3,227,551. These publications describe the use of a nondiffusible development inhibitor-forming coupler as in (b) capable of releasing a diffusible development inhibitor by the reaction thereof with an aromatic primary amine developing agent, and a nondiffusible dye-forming coupler as in (b) capable of releasing a diffusible dye by the reaction thereof with the same developing agent. In this case a positive image may be formed by the following mechanism: In the area where the exposed silver halide as in (a) has been developed, a development inhibitor is released from the compound as in (b), which action inhibits the development as in (c), and consequently no dye is substantially released from the compound as in (d). On the other hand, in the area where the silver halide has not been developed because of the unexposed area, no development inhibitor is released from the compound (b), so that the development of the emulsion (c) takes place, and the oxidized product of the developing agent produced in the development reacts with the compound (d) to thereby release a dye. Thus, a distribution of the dye released as the function of the exposure intensity may be obtained. However, the silver halide photographic light-sensitive material exemplified herein has some disadvantages one of which is such that the minimum density (D min) of a positive image to be finally obtained becomes increased by the competition between the process in which the development of the foregoing water-insoluble metallic salt-containing emulsion (c) is inhibited by the development inhibitor released from the compound (b) and the process in which the water-insoluble metallic salt comes into contact with the developing agent to cause a development, before the contact thereof with the development inhibitor. Another disadvantage is such that the developing agent to be used is limited only to such developing agents as p-phenylenediamine from the necessity of the effective reaction between the development inhibitor forming coupler (b) and the dye forming coupler (d). When a development is made using a developer solution containing such a kind of developing agent, stain intensely occurs to degrade the quality of the produced image;—this problem has been in question among those skilled in the art.

As has been mentioned, the color positive image forming silver halide photographic light-sensitive material comprising the combination of a negative type emulsion with a dye image-forming material includes various types, but they have various disadvantages and are still in unsatisfactory conditions. Particularly, that the minimum density is high and stain is observed is likely to become a decisive disadvantage in these days higher quality photographic image has been desired with the remarkable popularization of color photography. For this reason, the development of techniques to improve these disadvantages has now become a question of importance.

It is, therefore, an object of the present invention to provide a silver halide photographic light-sensitive material for use in the formation of a color positive image which has the low minimum density and is free of any stain.

As a result of having devoted ourselves to our studies, we have found that the above object of the present invention can be accomplished by a silver halide photographic light-sensitive material comprising;

a support;

a combination of an unfogged surface latent image type silver halide photographic emulsion and a material capable of releasing a diffusible development inhibitor or the precursor thereof imagewisely as the function of an exposure by development; and a combination of an internal latent image type silver halide photographic emulsion whose silver halide grains have in advance fog nuclei thereinside and a dye image-forming material capable of releasing an diffusible dye or the precursor thereof imagewisely as the function of an exposure by development. In addition, the internal latent image type silver halide photographic emulsion in advance having fog nuclei inside the silver halide particles thereof is hereinafter referred to as "internally fogged emulsion" and an unfogged surface latent image type silver halide photographic emulsion is referred to as "negative type emulsion".

The silver halide photographic light-sensitive material of the present invention, when exposed imagewise to light and then developed, is considered to form a color positive image through the following steps: Noticing the exposed portion, the silver halide of the negative type emulsion is first developed in the developing process to produce an oxidized product of the developing agent, which then oxidizes a certain development inhibitor-releasing compound that is combined with the negative type emulsion. From this step the development inhibitor is released and diffused into the internally fogged emulsion layer coated separately from the negative type emulsion, and then adsorbed into the surface of the silver halide particles of the internally fogged emulsion. Consequently, the silver halide particles are no longer developed, so that no image forming dye is released in the exposed area. On the other hand, in the unexposed area, the silver halide of the negative type emulsion is not developed, so that no oxidized product of the developing agent is produced, and naturally the development inhibitor releasing compound is not subjected to oxidation, leading to no release of the inhibitor nor adsorption of the inhibitor into the surface of the silver halide particles of the internally fogged emulsion, and thus the silver halide particles can be effectively developed under a certain condition. The oxidized product of the developing agent produced at this step then oxidizes the dye image forming material in combination with the internally fogged emulsion, and then from this step a dye for the image formation is released. This dye, for example, is diffused into an image receiving layer and then fixed to the layer.

The formation of a color positive image is considered to be made in the above way, but the color positive image-forming process is apparently similar to those disclosed in, e.g., Japanese Patent Examined Publication No. 21778/1968, U.S. Pat. Nos. 3,148,062 and 3,227,551. However, the silver halide photographic light-sensitive material of the present invention differs largely in some respects from those disclosed in the publications. One of the differences is given: What is described in Japanese Patent Examined Publication No. 21778/1968 is such that the process in which the water-insoluble salt (physical development nucleus) used in combination with the dye image-forming material is development-inhibited by the adsorption of the development inhibitor and the process in which the water-insoluble salt comes into contact with the developing agent to cause a development to occur before the contact thereof with the development inhibitor arise competitively and concurrently. As a result, the disadvantage that the minimum density becomes high has been unavoidable. While on the other hand, in the case of the present invention, since the internally fogged emulsion is used in combination with the dye image forming material, the above disadvantage can be avoided for the following reason: In order that the silver halide particles of the internally fogged emulsion is reduced by a developer, the fog nuclei present inside the silver halide particles must have an opportunity to come into contact with the developing agent. For this purpose, the surface portion of the silver halide particles is required to be dissolved or finelly cracked. Accordingly, there occurs some delay from the time when the developing agent contacts with the silver halide particles surface until the substantial commencement of the development, so that even if both the developing agent and the development inhibitor released from the development inhibitor-releasing compound concurrently reached the same silver halide particle surface, the development inhibitor would be sufficiently adsorbed into the silver halide particle surface prior to the commencement of the development, causing a very effective development inhibiting action to occur, and thus the minimum density would not be increased. This may be a significant advantage based on the selective use of the internally fogged emulsion, and may be what is clearly distinguished from the conventionally known art. In addition to this, there are some other differences from the prior art, which are described below:

As the composition of the silver halide of the negative type emulsion in the present invention, silver bromide, silver chloride, silver iodide or a combined composition of these silver halides may be advantageously used, and those particularly preferably usable may be silver chloroiodobromide, silver iodobromide, silver chlorobromide, silver bromide, and the like. And the proportion of the silver bromide content of the composition is preferably at least 50 mole %, and where silver iodide is contained, the silver iodide content is preferably in the range of from 0.1 to 10 mole %.

The above negative type emulsion used in the present invention may if necessary be chemically sensitized. For the chemical sensitization, those conventionally known methods such as the noble metal sensitization, sulfur sensitization or reduction sensitization, and the like may be employed, and these may be used singly or in combination of two of them for the sensitization.

In addition, the above negative type emulsion may be subjected to a stabilization or antifogging treatment by the use of a known stabilizer or antifoggant. For this purpose, there may be used azaindene compounds, triazole compounds, benzothiazolium compounds, mercapto group-having nitrogen-containing heterocyclic compounds, and the like. Among these additives, to be concrete, 4-hydroxy-6-methyl-1,3,3a, 7-tetrazaindene, 5-methyl benzothiazole, 5-methyl benzotriazole, 1-phenyl-5-mercaptotetrazole, 1-methyl-2-tetrazoline-5-thione, and the like may be particularly preferably used. The above negative type emulsion may be spectrally sensitized by the use of known spectral sensitizers and intense color sensitizers.

The negative type emulsion advantageously usable in the present invention may be prepared by various methods such as described in, e.g., Research Disclosure Vol. 192, item 19227 (April 1980).

Subsequently, the internally fogged emulsion advantageously usable in the present invention is illustrated: The internally fogged emulsion is an emulsion that has the following characteristics: when a test piece coated thereon with this emulsion is subjected to a 1 to 1/1000 sec. exposure and then developed in the following internal developer solution at 20° C. for 5 minutes, the maximum density of the test piece is to be at least 5 times, preferably, exceeding ten times the maximum density obtained by developing the same in the following surface developer solution at 20° C. for 6 minutes. And the fogging degree of the emulsion is such that when a test sample obtained by coating on a transparent support such as polyethylene terephthalate film the internally fogged emulsion so that the silver equivalent coating amount is from 3.5 to 4.5 g/m$^2$ is developed for 5 minutes in the following internal developer solution at 20° C., the transmission density of the sample is at least 0.50, preferably, exceeding 1.0. Further, the above internally fogged emulsion is an emulsion whose surface is unfogged, which is such that when the foregoing coated piece is subjected to a 1 to 1/100 sec. exposure and then developed for 6 minutes in the following surface developer solution at 20° C., the maximum density is not more than 0.40, and preferably not more than 0.25.

| Internal developer solution: | |
|---|---|
| N—methyl-p-aminophenol sulfate | 2.0 g |
| Sodium sulfite, anhydride | 90.0 g |
| Hydroquinone | 8.0 g |
| Sodium carbonate, monohydrated | 52.5 g |
| Potassium bromide | 5.0 g |
| Potassium iodide | 0.5 g |
| Water to make | 1.0 liter |
| **Surface developer solution:** | |
| N—methyl-p-aminophenol sulfate | 2.5 g |
| Ascorbic acid | 10.0 g |
| Potassium metaborate | 35.0 g |
| Potassium bromide | 1.0 g |

-continued

| | |
|---|---|
| Water to make | 1.0 liter |
| | (pH = 9.6) |

The internally fogged emulsion may be prepared in various manners; for example, in such a manner that a silver halide emulsion that has sensitivity in both the inside and the surface thereof is fogged, and then the fog on the surface is broken by being treated with such an oxidizing agent as an aqueous potassium ferricyanide solution. The fogging method used herein includes such known methods as the method wherein the above silver halide emulsion is ripened by heating under the low pAg condition, the method for chemically fogging by the use of a fogging agent, the method of entirely exposing to light, and the like, and these methods may be used singly or in combination. In addition, there is another method that an unfogged internal latent image type silver halide emulsion is subjected to a radiation having high energy such as X-rays. A further method is such that a fog nucleus-having silver halide is first prepared as a core, which is coated thereon with another silver halide free of fog to thereby form a shell. The preparation of the fogged core particles mentioned may be accomplished by a chemically sensitizing treatment to an appropriate extent of the silver halide with the single or combined use of such methods widely known to those skilled in the art as the methods of noble metal sensitization, sulfur sensitization, reduction sensitization, and the like. The thus prepared internally fogged emulsion has a particle diameter in the range of from 0.15 to 3.0 μm, preferably from 0.2 to 1.0 μm and desirable to be the so-called single dispersible emulsion having a relatively small particle size distribution.

In order to prepare the core/shell type particles for the above internally fogged emulsion to be used in the present invention, silver halide particles to become a core is first formed, which is then subjected to a gold sensitization treatment under a relatively high Ag potential condition, and further coated with an unfogged silver halide. The average thickness of the shell-forming layer in the core/shell type structure is from 0.01 to 0.3 μm, and preferably from 0.02 to 0.15 μm. The thus prepared silver halide may be favorably used for attaining the object of the present invention.

The silver halide composition of the internally fogged emulsion advantageously usable in the present invention includes silver chloride, silver bromide, silver iodide, and a combination of these silver halides, those particularly preferred among which are silver chloride, silver bromide, silver iodobromide, silver chlorobromide, silver iodochlorobromide. And the silver iodide content of the above composition of the present invention is not more than 10 mole %, and preferably not more than 3 mole %.

According to a preferred embodiment of the present invention, a less-solubilizing agent is added to the internally fogged emulsion to lower the solubility of the silver halide particles thereof. The less-solubilizing agent adsorbed into the silver halide particle surface serves to inhibit the development of the silver halide of the internally fogged emulsion in cooperation with the development inhibitor released as the result of the development of the negative type emulsion to thereby lower the minimum density of the resulting photographic image. The preferred less-solubilizing agent to be used in the present invention includes, e.g., mercapto compounds typical examples of which are cysteine, 1-phenyl-5-mercaptotetrazole, mercaptobenzothiazole, and the like. Thiourea-indazoles, triazoles and imidazoles may also be preferably used in the present invention. The adding amount of such less-solubilizing agents to the internally fogged emulsion is preferably from 140 to 1400 mg, and more preferably from 150 to 850 mg per mole of the silver halide of the internally fogged emulsion.

One of the characteristics of the present invention is such that the dye image-forming material capable of releasing an imagewise diffusible dye or the precursor thereof as the function of an exposure by development is combined with the internally fogged emulsion. The dye image forming material advantageously usable in the present invention includes nondiffusible dye releasing type redox compounds, i.e., materials of the type initially nondiffusible under an alkaline condition but becoming able to release a diffusible dye or the precursor thereof as the result of being oxidized by the redox reaction with the oxidized product of the developing agent (said materials being hereinafter referred to as "DRR compounds"). Such DRR compounds are as described in, e.g., U.S. Pat. Nos. 3,932,381, 3,928,312, 3,931,144, 3,954,476, 3,929,760, 3,942,987, 3,932,380, 4,013,635 and 4,013,633, Japanese Patent O.P.I. Publication Nos. 113624/1976, 109928/1976, 104343/1976 and 4819/1977, and Research Disclosure No. 15162 (November 1976), and the like, preferred ones among which are those compounds having the formula:

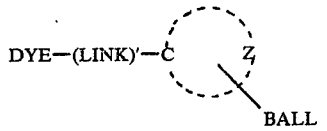

Formula (I)

wherein (LINK)' is —O—, —S—, —$SO_2$— or —$SO_2NH$ wherein nitrogen is attached to

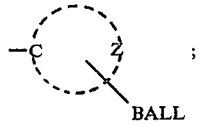

;

Z is a group of nonmetallic atoms necessary to form a 5- or 6-membered ring together with the carbon atom bonding with the (LINK)', said bonding being cleavable under an alkaline condition in the redox reaction with the foregoing oxidized product of the silver halide developing agent; DYE is a diffusible dye group or a diffusible dye precursor group; and BALL is a photographically inert ballasting group having such a molecular size and/or conformation as to cause the nondiffusible dye image forming material having Formula (I) to be nondiffusible under an alkaline condition.

Particularly preferred examples of the

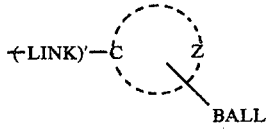

of the DRR compounds having Formula (I) are those of the following formulas (Ia), (Ib), (Ic), (Id), (Ie) and (If):

Formula (Ia)

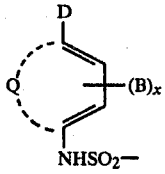

wherein Q is a group of nonmetallic atoms necessary to form a 6-member aromatic ring (including those combined with a saturated or unsaturated carbon ring or heterocyclic ring).

Preferred examples of the 6-member aromatic ring includes benzene ring, naphthalene ring, quinoline ring, tetralin ring, and the like.

B is a hydrogen halogen, sulfo, carboxyl, an alkyl, an aryl, an alkoxy, an aryloxy, nitro, amino, cyano, an alkylamino, an arylamino, an alkylthio, or a heterocyclic ring such as pyridyl group which is combined, directly or through such a group as

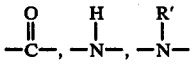

(wherein R' is an alkyl), alkylene (allowed to be branched), —O—, —S—, —$SO_2$—, phenylene (allowed to be substituted with an alkyl or the like) or a group in arbitrary combination of these groups, with the 6-member aromatic ring formed with Q.

Further examples in detail of preferred groups or atoms represented by B include hydrogen, halogens, lower alkyl, alkoxy, acylamino groups and ballasting groups capable of making DRR compounds of Formula (I) nondiffusible under an alkaline condition, particularly under the condition of a hydrogen ion concentration of $10^{-5}$ to 2 mol/liter. These ballasting groups include preferably 8 to 32 carbon atoms-having alkyl, alkoxy, aryloxy, amino, acylamino, sulfoamino, ureido, alkoxycarbonyl, carbamoyl, sulfamoyl groups (these groups are permitted to be further substituted with an alkyl, aryl, alkoxyalkyl, alkylaryl, alkyl-aryloxyalkyl, acylamidoalkyl, alkoxyaryl, aryloxyaryl group, etc.).

D represents a group of —$OR^{(1)}$ or —$NHR^{(2)}$ wherein $R^{(1)}$ is preferably hydrogen or may be a group cleavable from the oxygen under the condition of a hydrogen ion concentration of $10^{-5}$ to 2 mol/liter. This cleavable group includes preferably a group represented by, e.g.,

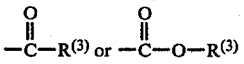

wherein $R^{(3)}$ is an alkyl, preferably an alkyl having from 1 to 5 carbon atoms, such as —$CH_3$, —$C_2H_5$, —$C_2H_7$(n), —$C_4H_9$(iso), —$C_5H_{11}$(n), or the like, and further a halogen-substituted alkyl such as —$CH_2Cl$, —$CF_3$ or the like is also preferred. In addition, $R^{(3)}$ may also be a phenyl such as —$C_6H_5$, —$C_6H_4Cl$, —$C_6H_4CN$, or the like.

$R^{(2)}$ is hydrogen or an alkyl group, preferably an alkyl having from 1 to 22 carbon atoms, such as, e.g., —$CH_3$, —$C_3H_7$(n), —$C_{12}H_{25}$(n) or the like, or may be a group cleavable from the nitrogen atom under the condition of a hydrogen ion concentration of $10^{-5}$ to 2 mol/liter. This cleavable group includes preferably

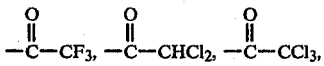

or the like.

X is an integer of 1, 2 or 3. When X is an integer of 2 or 3, the $B_s$ may be either the same or different groups. In addition, in the group represented by Formula (Ia), to render the DRR compound having Formula (I) nondiffusible under an alkaline condition, particularly under the condition of a hydrogen ion concentration of $10^{-5}$ to 2 mol/liter, the total number of the carbon atoms of both the alkyl portion represented by the $R^{(2)}$ in the —$NHR^{(2)}$ in the D and the (B)x of Formula (Ia) is desirable to be not less than 8, particularly at least one of the (B)x is desirable to be a ballasting group having not less than 8 carbon atoms. Preferred examples are enumerated below:

(Ia-1)

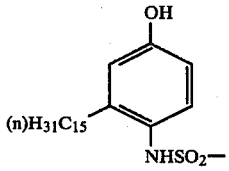

(Ia-2)

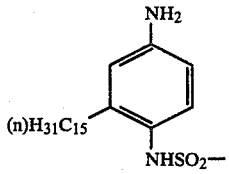

(Ia-3)

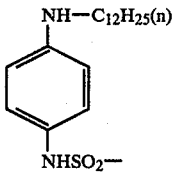

(Ia-4)

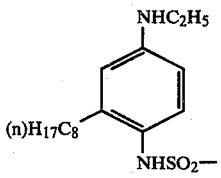

(Ia-5)

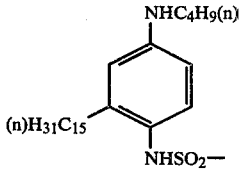

(Ia-6)

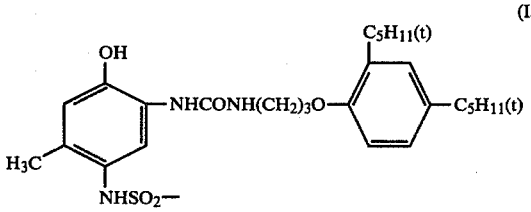

-continued
(Ia-7)
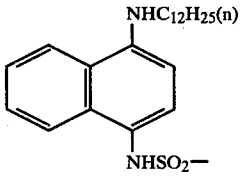
(Ia-8)
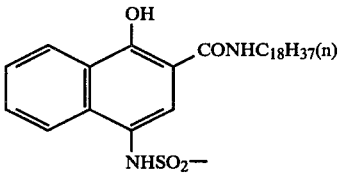
(Ia-9)
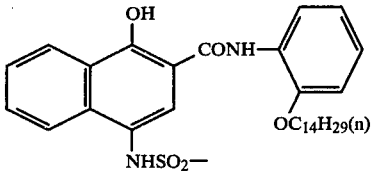
(Ia-10)
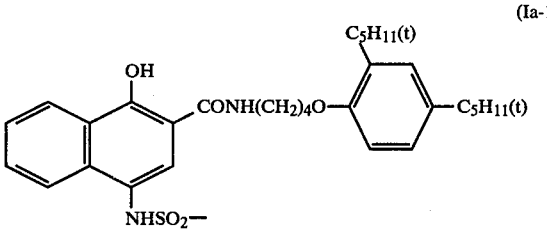
(Ia-11)
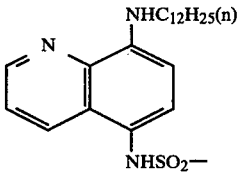
(Ia-12)
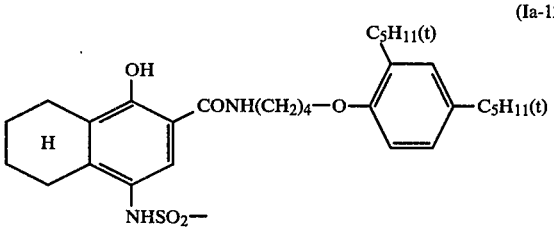
(Ia-13)
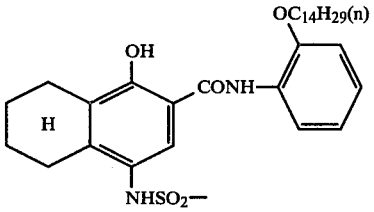
(Ia-14)
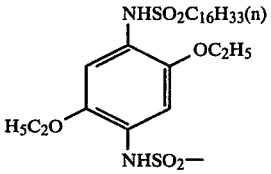
-continued
(Ia-15)
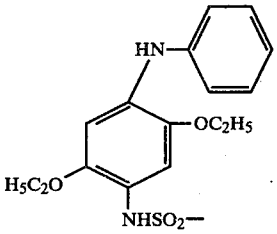
(Ia-16)
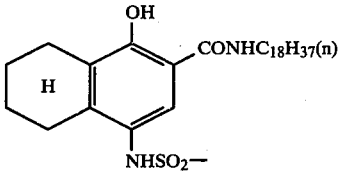
(Ia-17)
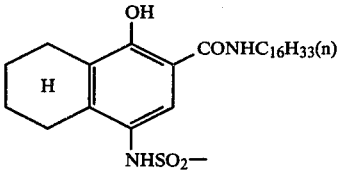
(Ia-18)
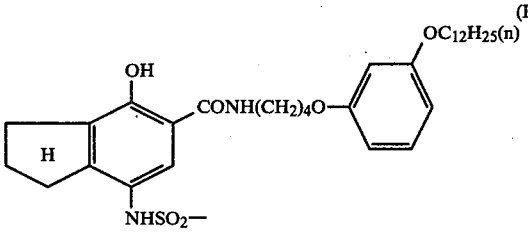
(Ia-19)
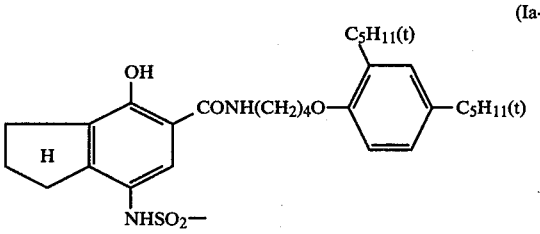
Formula (Ib)
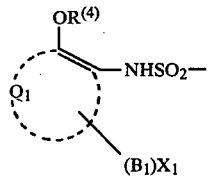
Wherein $Q_1$, $B_1$, $R^{(4)}$ and $X_1$ are as defined for the Q, B, $R^{(1)}$ and X, respectively in Formula (Ia), typical examples of which are enumerated below:
(Ib-1)
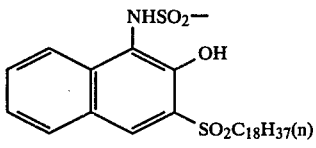

-continued
(Ib-2)
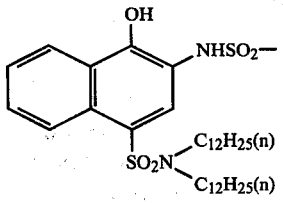
(Ib-3)
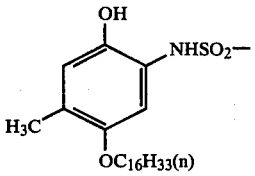
(Ib-4)
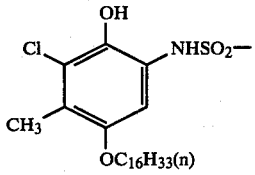
(Ib-5)
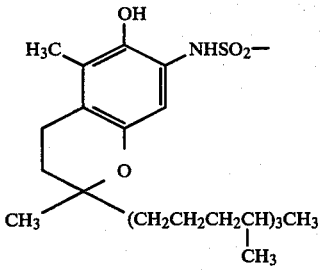
(Ib-6)
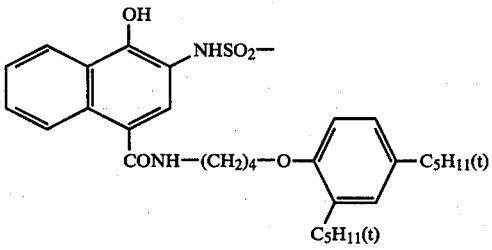
(Ib-7)
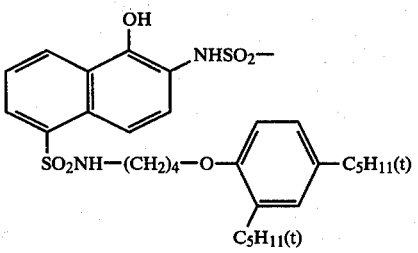
(Ib-8)
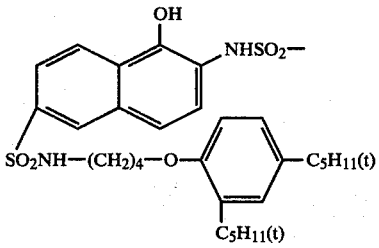
-continued
(Ib-9)
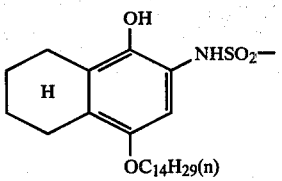
(Ib-10)
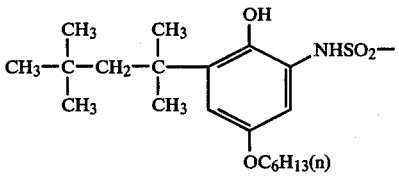
(Ib-11)
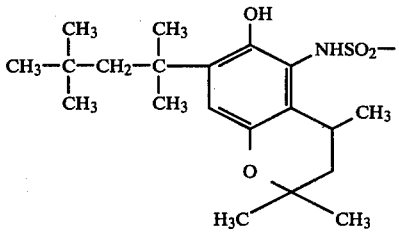
(Ib-12)
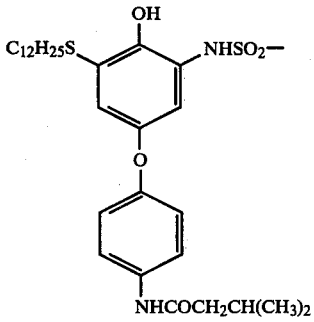
(Ib-13)
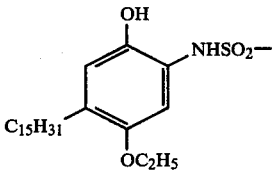
(Ib-14)
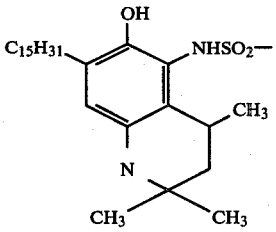
(Ib-15)
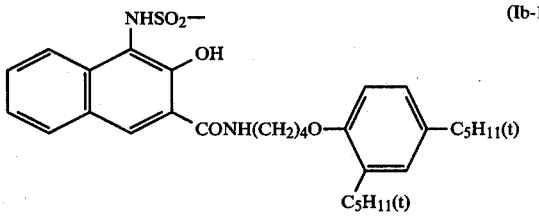

-continued (Ib-16)

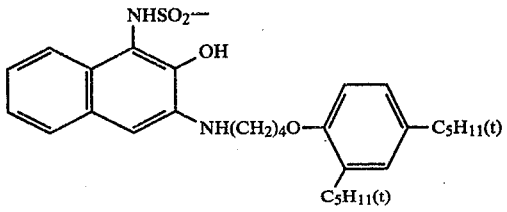

(Ib-17)

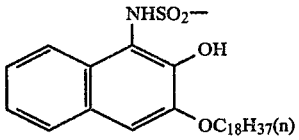

(Ib-18)

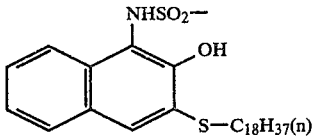

(Ib-19)

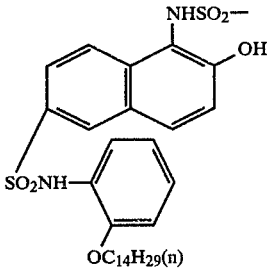

Formula (Ic)

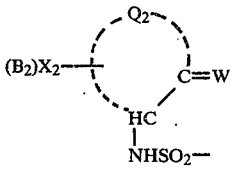

wherein $B_2$ and $X_2$ are as defined for the B and X in Formula (Ia); W is oxygen or $=NR^{(5)}$ wherein $R^{(5)}$ is hydroxyl group or amino group which is allowed to have a substituent, and particularly when W is $=NR^{(5)}$, $R^{(5)}$ is represented by the $R^{(5)}$ in the $>C=N-R^{(5)}$ formed as the result of the dehydration reaction of carbonyl reagent represented by $H_2N-R^{(5)}$ with ketone group, and those compounds represented by the $H_2H-R^{(5)}$ include, e.g., hydroxylamines, hydrazines, semicarbazides, thiosemicarbazides, and the like. To be more concrete, hydrazines include hydrazine, phenyl hydrazine, substituted phenyl hydrazines whose phenyl has such a substituent as an aryl, alkoxy, carbalkoxy, halogen, or the like, hydrazine isonicotinate, and the like. Semicarbazides include phenyl semicarbazide, substituted phenyl semicarbazides having such a substituent as an alkyl, alkoxy, carbalkoxy, halogen, etc., and the like. Thiosemicarbazides include various derivatives similar to those of semicarbazides.

$Q^2$ in the formula is a group of nonmetallic atoms necessary to form a saturated or unsaturated nonaromatic hydrocarbon 5- or 6-member ring together with the carbon atom, the hydrocarbon ring including, e.g., cyclopentane, cyclohexane, cyclohexene, cyclopentene, and the like.

Further, the 5- or 6-member nonaromatic hydrocarbon ring also includes those formed of a condensed ring by condensing in an appropriate position thereof with another ring that may be one of various rings regardless of whether it indicates aromaticity or whether it is a hydrocarbon ring or heterocyclic ring, but, in forming a condensed ring, is more desirable to be such a condensed ring as formed by the condensation of benzene ring with the above 5- or 6-member nonaromatic hydrocarbon ring, such as in benzcyclopentene, benzcyclohexene, and the like. Examples of those having Formula (Ic) include the following:

(Ic-1)

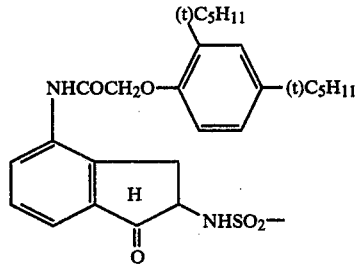

(Ic-2)

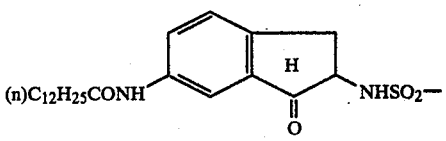

(Ic-3)

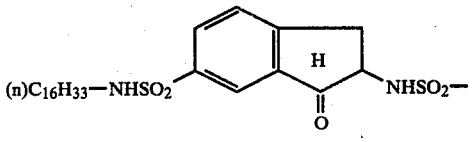

(Ic-4)

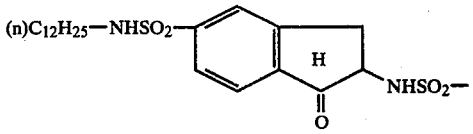

(Ic-5)

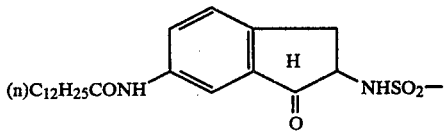

(Ic-6)

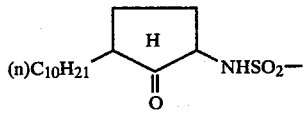

(Ic-7)

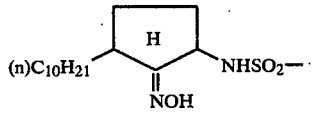

(Ic-8)

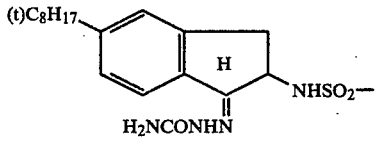

-continued

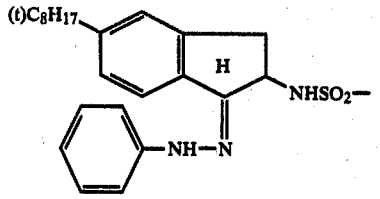

(Ic-9)

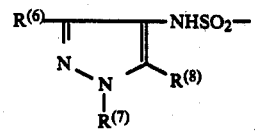

Formula (Id)

wherein $R^{(6)}$ is preferably an alkyl, an acylamino or an arylamino, and these groups are allowed to be substituted further by an alkoxy, alkylthio, aryloxy, sulfo, carboxyl, acylamino, hydroxyl or sulfamoyl group, or a halogen or the like. $R^{(7)}$ is an alkyl, an aryl such as phenyl, or an acyl such as an alkylcarbonyl, an aryl-sulfonyl or a heterocyclic group or the like, and these groups may be substituted further by a halogen, sulfo group or the like. $R^{(8)}$ is $—OR^{(9)}$ wherein $R^{(9)}$ is as defined for the $R^{(1)}$ in Formula (Ia), or $—NR^{(10)}R^{(11)}$ wherein $R^{(10)}$ and $R^{(11)}$ each is hydrogen, an alkyl, an aryl, a heterocyclic group or acyl group, and further may form a 5- or 6-member heterocyclic ring containing at least one oxygen atom or nitrogen atom together with the $R^{(7)}$ and $R^{(8)}$, and in the group having Formula (Id), in order to render the DRR compound having Formula (I) nondiffusible under an alkaline condition, particularly under the condition of a hydrogen ion concentration of $10^{-5}$ to 2 mol/liter, at least one of the $R^{(6)}$ or $R^{(7)}$ is desirable to be a ballasting group having not less than 8 carbon atoms as defined in Formula (Ia).

Preferred examples of those groups having Formula (Id) are given below:

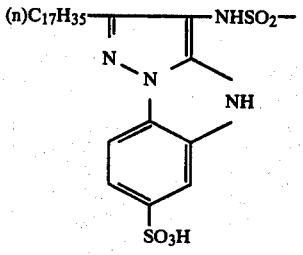

(Id - 1)

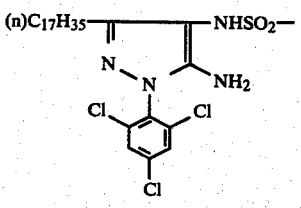

(Id - 2)

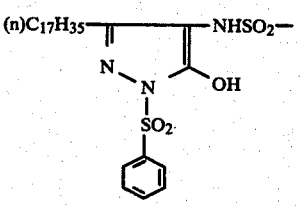

(Id - 3)

-continued

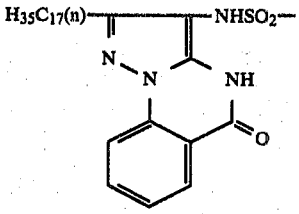

(Id - 4)

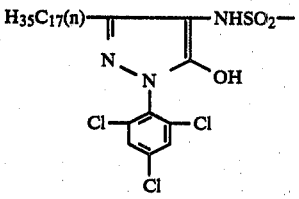

(Id - 5)

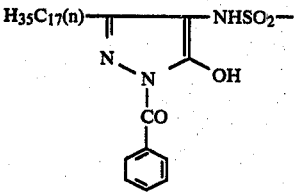

(Id - 6)

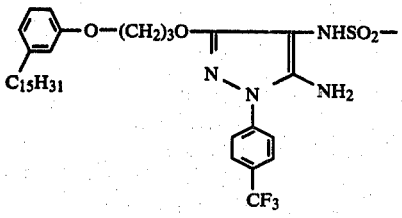

(Id - 7)

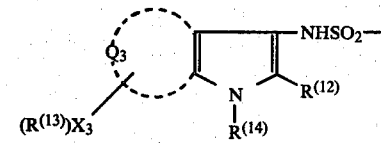

Formula (Ie)

wherein $Q_3$ is a group of nonmetallic atoms necessary to form a 5- or 6-member ring, and preferably an aromatic 6-member ring; $R^{(12)}$ is hydrogen, a halogen, hydroxyl, cyano, amino, an alkyl, an aryl, an acyl, carbamoyl, carbonamide, an alkoxycarbamoyl or a heterocyclic group; $R^{(13)}$ is hydrogen, a halogen, hydroxyl, cyano, carboxyl, an alkyl, an aryl, an alkoxy, an acyl, amino, carbonamide or an acyloxy group; and $R^{(14)}$ is hydrogen, an alkyl, an aryl or a heterocyclic group.

$X_3$ in the formula is an integer of from 1 to 4. When $X_3$ is from 2 to 4, each $R^{(13)}$ may be the same or different. $R^{(14)}$ may form a 5- or 6-member heterocyclic ring together with $R^{(12)}$ and/or $R^{(13)}$. Each of the groups of $R^{(12)}$, $R^{(13)}$ and $R^{(14)}$ may be substituted further by an alkyl, an aryl, an alkoxyalkyl, an alkyl-aryl, an alkyl-aryloxyalkyl, an acylamidoalkyl, an alkoxyaryl, an aryloxyalkyl group or the like.

In the group represented by Formula (Ie), in order to render the DRR compound having Formula (I) nondiffusible, the total number of the carbon atoms of $R^{(12)}$, $R^{(13)}$ and $R^{(14)}$ is desirable to be not less than 8, particularly at least one of the $R^{(12)}$, $R^{(13)}$ and $R^{(14)}$ is desirable to be a ballasting group (as defined in Formula (Ia)) having not less than 8 carbon atoms. Examples are given below:

(Ie-1)

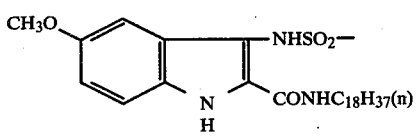

(Ie-2)

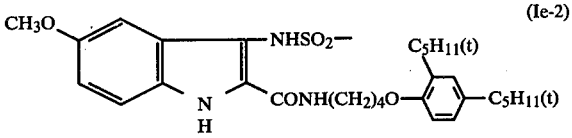

(Ie-3)

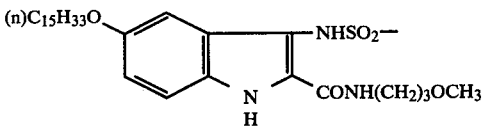

(Ie-4)

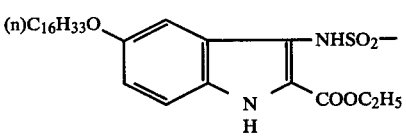

(Ie-5)

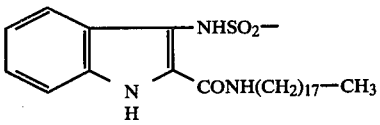

(Ie-6)

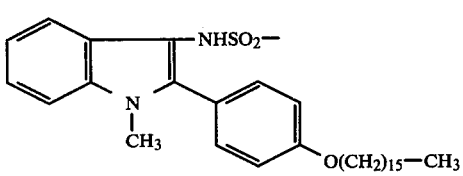

Formula (If)

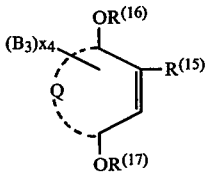

wherein $B_3$ and $Q_4$ are as defined for the B and Q, respectively in Formula (Ia), and $R^{(16)}$ and $R^{(17)}$ each is as defined for the $R^{(1)}$ in Formula (Ia); $X_4$ is an integer of from 1 to 3, and when $X_4$ is 2 or 3, each $B_3$ may be either the same or different; $R^{(15)}$ represents —O—, —S— or —$SO_2$—; and at least one of the $R_3$s is desirable to be the foregoing ballasting group. Typical examples are given below:

(If-1)

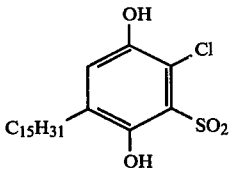

-continued (If-2)

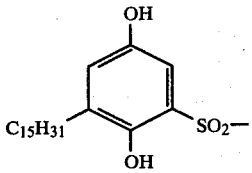

(If-3)

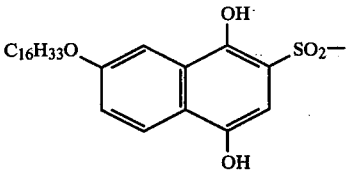

(If-4)

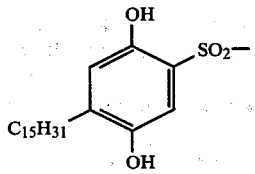

(If-5)

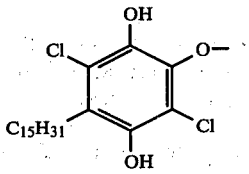

(If-6)

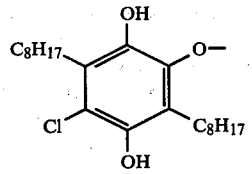

In Formula (I), DYE includes dyes well-known to those skilled in the art, such as, e.g., azo dyes, azomethine dyes, indoaniline dye, indophenol dye, anthraquinone dye, azopyrazolone dye, alizarin dye, merocyanine dye, cyanine dye, indigo dye, phthalocyanine dye, and the like. Diffusible dye precursors as DYE include leuco dyes (those leuco dyes in the dye developers as described in, e.g., Japanese Patent O.P.I. Publication No. 66440/1973), shift type dyes (dyes whose absorption spectrum shifts toward either lighter or deeper color during the alkaline processing thereof, such as in the acyloxynaphthylazo dye described in Japanese Patent Application No. 77148/1976, or dyes whose absorption spectrum shifts toward either lighter or deeper color during the dyeing to the image receiving layer), and the like.

In the silver halide photographic light-sensitive material of the present invention, any combination of the dye image-forming material with the internally fogged emulsion may be incorporated into any of the component layers of the light-sensitive material, but the preferred incorporation is either such that both the dye image forming material and the internally fogged emulsion are present together in a same layer or such that they are separately present in two different layers contiguous to each other, and of these incorporating ways the former is particularly preferred. In the case of the latter, a light-sensitive material comprises a light-sensitive negative type emulsion layer in combination with a development inhibitor releasing material, a layer containing a dye image forming material, and an internally fogged emulsion layer, the component layers of said unit being so arranged that the internally fogged emulsion layer is sandwiched between the dye image-forming material-containing layer and the negative type emulsion layer. And the negative type emulsion layer in combination with the diffusible development inhibitor releasable material may also be arranged, for example, so as not to be in direct contact with the internally fogged emulsion layer by placing a gelatin interlayer therebetween.

In the silver halide photographic light-sensitive material of the present invention, as the material which is nondiffusible under an alkaline condition and which becomes able to release a diffusible development inhibitor or the precursor thereof as the result of the cross oxidation with the oxidized product of the developing agent, those compounds may be advantageously used which have the formula:

Formula (II)

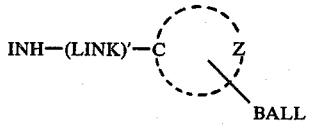

wherein INH represents a diffusible development inhibitor or the precursor thereof, and the

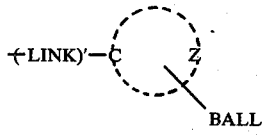

is as defined in Formula (I).

The INH includes those groups consisting of materials known as development inhibitors, antifoggants or stabilizers to those skilled in the art, and is preferably of 5- or 6-member heterocyclic ring. Examples of the heterocyclic groups include tetrazolyl, triazolyl, thiazolyl, oxadiazolyl, tetrazaindenyl, oxazolyl, thiazolyl, imidazolyl groups and the like.

Particularly useful ones represented by the foregoing INH in the present invention have the following Formula (IIa) or (IIb):

Formula (IIa)

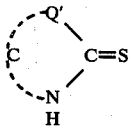

wherein Q' is a group of atoms necessary to form a heterocyclic ring (the ring is allowed to be substituted).

Formula (IIb)

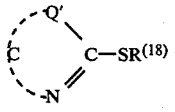

wherein Q' is as defined in Formula (IIa), and $R^{(18)}$ is hydrogen, an alkoxycarbonyl, an cyanoalkyl, an arylsulfonylalkyl, carbonamide group or the like.

Those compounds having an alkoxycarbonyl group as $R^{(18)}$ are described in, e.g., U.S. Pat. No. 3,364,028; cyanoalkyl group-having compounds are described in, e.g., U.S. Pat. No. 4,009,029 and Japanese Patent O.P.I. Publication No. 28823/1975; aryl-sulfonyl-alkyl group-having compounds are described in Japanese Patent O.P.I. Publication No. 139365/1980; and carbonamide group-having compounds are described in Japanese Patent O.P.I. Publication No. 53330/1980.

The following are examples of the material which is capable of releasing a diffusible development inhibitor or the precursor thereof as the result of being oxidized under an alkaline condition provided that those advantageously useful in the present invention are not limited to the following examples:

(1)

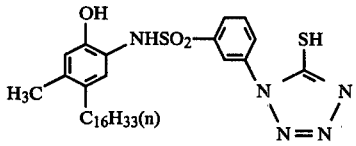

(2)

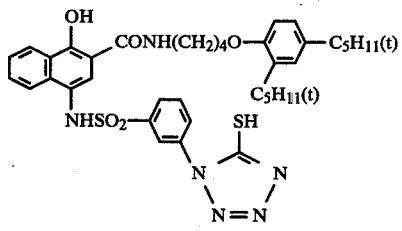

(3)

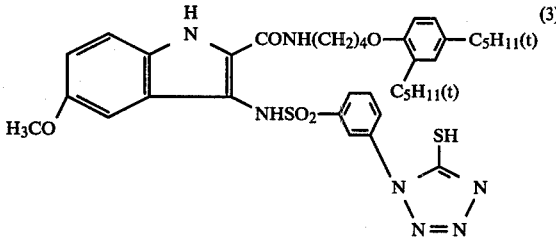

(4)

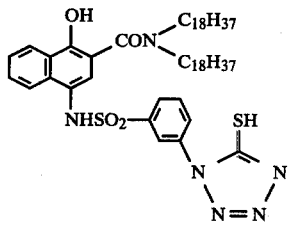

(5)

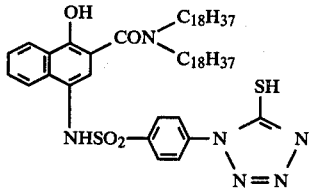

(6)

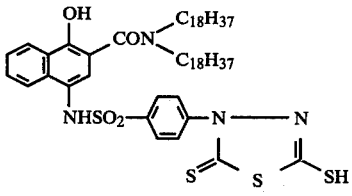

-continued
(7)
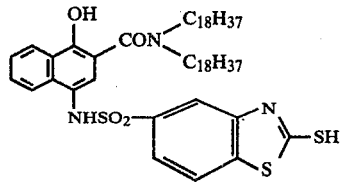
(8)
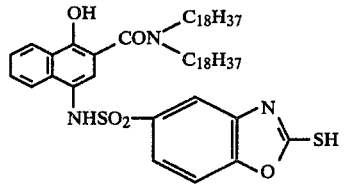
(9)
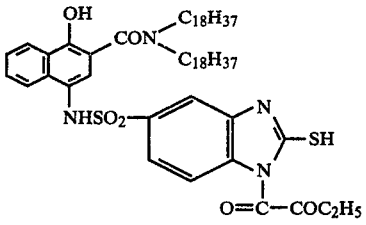
(10)
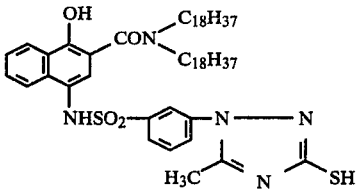
(11)
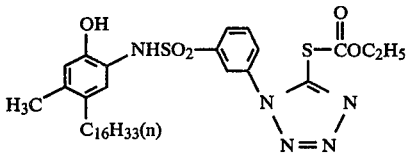
(12)
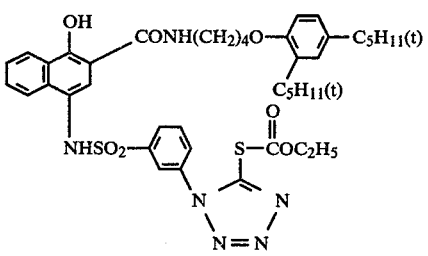
(13)
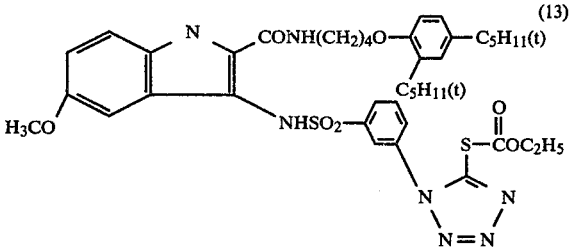
-continued
(14)
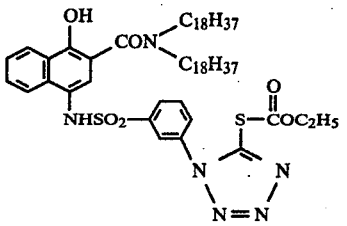
(15)
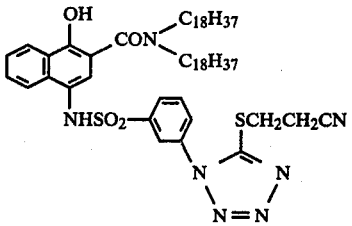
(16)
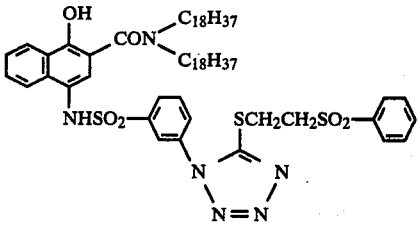
(17)
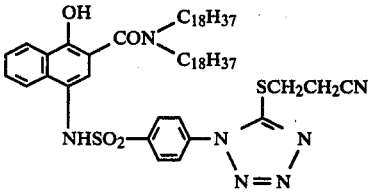
(18)
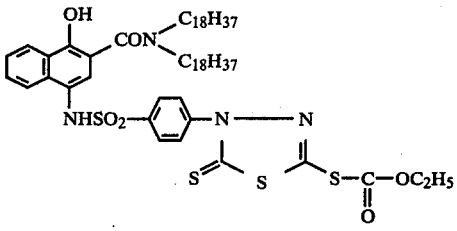
(19)
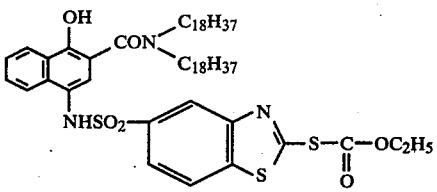
(20)
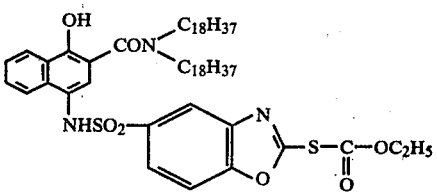

-continued (21)

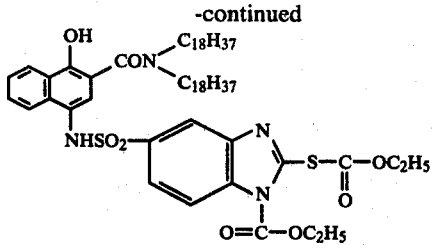

(22)

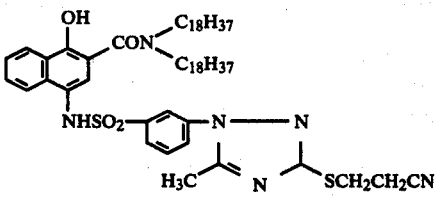

(23)

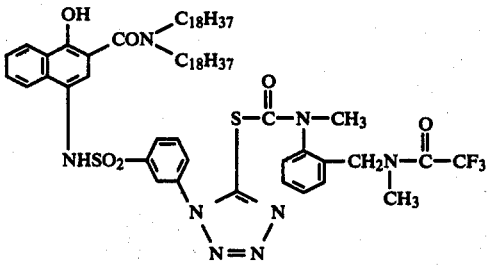

(24)

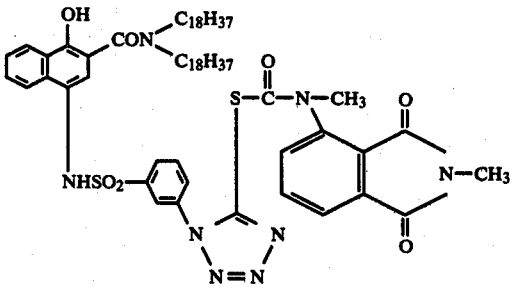

(25)

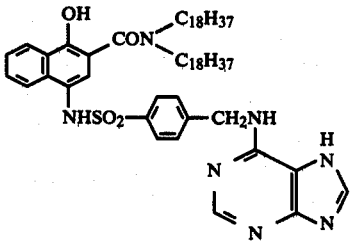

(26)

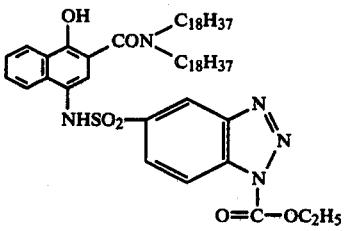

In the above-exemplified compounds, the compounds (11) and (24) are the examples where the $R^{(18)}$ in Formula (IIb) is not hydrogen, and when such compounds are used in the silver halide photographic light-sensitive material of the present invention, the changes in the characteristics of the light-sensitive material are small as compared to those where the $R^{(18)}$ is hydrogen.

These compounds having Formula (II) may be synthesized in similar manners to the methods for synthesizing DRR compounds as described in, e.g., Japanese Patent O.P.I. Publication Nos. 33826/1973, 104343/1976, 113624/1976, 54021/1979, and the like provided the dye or dye precursor groups of the DRR compounds are replaced by such nitrogen-containing heterocyclic groups as indicated above. These compounds represented by Formula (II) are described in, e.g., U.S. Pat. No. 4,135,929, Japanese Patent O.P.I Publication Nos. 54021/1979 and 59461/1980, and the synthesis methods thereof also are already known.

The above compounds each having Formula (II) is oxidized under an alkaline condition and, as a result, hydrolyzed to thereby release a diffusible development inhibitor or the precursor thereof, but it is particularly desirable for the least possible minimum density that the relative reaction rate in this process is not smaller than the relative reaction rate at the time when the diffusible dye is released from the DRR compound by the oxidation and the successive hydrolysis. It is well known to those in the art that the relative reaction rate changes depending on the kind of the so-called carrier portions represented by Formulas (Ia) to (If). Accordingly, the selection of a carrier portion can control the order in the degree of the relative reaction rate. The relative reaction rate may be determined by using the method as described in, e.g., Japanese Patent O.P.I. Publication No. 46755/1980.

In the silver halide photographic light-sensitive material of the present invention, when a compound having Formula (II) is used, the compound may be used in combination with the negative type emulsion to be incorporated into any layer of the light-sensitive material's component layers, and the preferred incorporation is either such that both the compound and the negative type emulsion are present together in a same layer or such that the compound and the negative type emulsion are present separately in two layers contiguous to each other, respectively, and of them the latter is particularly preferred. In the case of the latter, the layer containing the compound having Formula (II) is placed between the negative type emulsion layer and the internally fogged emulsion layer. And in this case, a gelatin interlayer may be provided between the compound-containing layer and the internally fogged emulsion layer.

According to a preferred embodiment of the present invention, the silver halide photographic light-sensitive emulsion has on the support thereof a multilayered unit consisting of the following component layers: (1) a negative type emulsion layer, (2) a layer containing a compound capable of releasing a diffusible development inhibitor by being oxidized under an alkaline condition, and (3) a layer containing both the internally fogged emulsion and the DRR compound.

According to another preferred embodiment of the present invention, the silver halide photographic light-sensitive material has on the support thereof a multilayer unit consisting of (1) a negative type emulsion, (2) a layer containing a compound capable of releasing a diffusible development inhibitor by being oxidized under an alkaline condition, (3) an interlayer, (4) an internally fogged emulsion layer, and (5) a DRR compound-containing layer.

According to a further preferred embodiment of the present invention, in each of the above embodiments, both the negative type emulsion and the compound capable of releasing a diffusible development inhibitor by being oxidized under an alkaline condition are incorporated together in a same layer.

For a color photographic light-sensitive material, not less than three units of the above embodiment are provided in combination on a support. In this case, for example, not less than one multilayer unit having a blue-sensitive negative type emulsion and a yellow dye releasable dye image-forming material, not less than one multilayer unit having a green-sensitive negative type emulsion and a magenta dye releasable dye image-forming material, and not less than one multilayer unit having a red-sensitive negative type emulsion and a cyan dye releasable dye image-forming material are provided in combination. And to prevent the colors from mixing, appropriate interlayers each is provided between these layers.

To the interlayers provided inside and between the respective multilayer units may be added such a developing agent oxidant scavenger and the like as described in, e.g., Research Disclosure item 15162, p83 (November 1976).

Further, the silver halide photographic light-sensitive material of the present invention is allowed to have on a known support, in addition to the above-described component layers, at need various component layers such as a protective layer, filter layer, backing layer, light-reflective layer, opaque layer, acid-neutralizing layer, image receiving layer, and the like. As the hydrophilic binder material for these component layers there may be employed gelatin, known gelatin derivatives, known hydrophilic macromolecular compounds, or the like, and there may also be added to the above component layers for improving the physical characteristics thereof at need such hardeners as, e.g., aldehyde compounds, vinyl-sulfone compounds, plasticizers, wetting agents, and the like.

The thus composed silver halide photographic light-sensitive material of the present invention is first subjected to an exposure to light and then to a development. As a silver halide developing agent for the development any compounds cross-oxidizable with a DRR compound and with the foregoing development inhibitor-releasing compound may be used, among which such developing agents for B/W materials as 3-pyrazolidinone derivatives, hydroquinones, p-aminophenols, etc., are desirable, and particularly desirable developing agents are the 3-pyrazolidinone derivatives. These developing agents may be in advance incorporated into an arbitrary layer of the silver halide photographic light-sensitive material so as to react with the silver halide of the layer during the immersing in a high pH aqueous solution or may also be incorporated into the alkaline processing composition.

The processing composition to be used in the present invention is allowed to further contain a dissolving agent for the silver halide crystals. Such a dissolving agent may also be incorporated arbitrarily into the respective layers of the silver halide photographic light-sensitive material. Typical examples of such dissolving agents for the silver halide crystals include sulfites such as sodium sulfite and the like; thiosulfates such as sodium thiosulfate, potassium thiosulfate, ammonium thiosulfate, and the like; cyanates such as potassium cyanate, sodium cyanate, and the like; thiocyanates such as sodium thiocyanate, ammonium thiocyanate, and the like; amino acid compounds such as cystine, cysteine, and the like; thiourea compounds such as thiourea, phenyl thiourea, 3,6-di-thia-1,8-octadiol, and the like; and thioether compounds and the like.

The processing composition may further contain a specific antifoggant. Useful antifoggants include conventionally known heterocyclic thiones, aromatic and aliphatic mercapto compounds, and the like.

The silver halide photographic light-sensitive material of the present invention, after being exposed to light, may be developed with a known viscous developer that is usually used in the color diffusion process.

Where the photographic light-sensitive material of the present invention is such a photographic film unit that the film unit is arranged so as to be processed by passing between a pair of juxtaposed pressure members, the film unit comprises the following elements:

(1) A light-sensitive element having not less than one multilayer unit consisting of an unfogged surface latent image type silver halide photographic emulsion layer in combination with a development inhibitor releasing compound having Formula (II) and an internally fogged emulsion layer in combination with a DRR compound having Formula (I), (2) an image receiving layer containing a polymer mordant, (3) a processing element having a means such as, e.g., a rupturable container to release an alkaline processing composition inside the film unit and a developer such as, e.g., 3-pyrazolidinone derivative, and (4) a support.

The light-sensitive element in the above film unit, after exposure, is superposed face-to-face upon the image-receiving element to be processed generally by the alkaline processing composition spread between the two elements. At this time, the image receiving element may be peeled apart after the transfer of the dye image or may be provided without peeling apart for viewing the color image as described in U.S. Pat. No. 3,415,645.

In another example, the image receiving layer in the above-described film unit may also be arranged so as to be integrated with the support and the light-sensitive element into a unit; for example, as described in Belgium Patent No. 757,960, a film unit with a support coated thereon with an image receiving layer, a substantially opaque light-reflective layer (e.g., a titanium dioxide layer and carbon black layer) and a light-sensitive element consisting of a single or plural light-sensitive layers is effectively used. The light-sensitive element, after exposure, is superposed face-to-face upon an opaque cover sheet (an alkali-neutralizing sheet is desirable) and a processing composition is spread between the two.

Another embodiment suitable for the present invention is of the type prepared by superposing to be integrated into a unit as described in Belgium Patent No. 757,959. According to this embodiment, a transparent support is coated thereon with an image-receiving layer, a substantially opaque light-reflective layer (as afore-mentioned) and a light-sensitive element consisting of the above-mentioned single or plural light-sensitive layers, and further a transparent cover sheet (an alkali-neutralizing system-containing sheet is desirable) is superposed thereupon. A rupturable container containing an opacifier (such as carbon black)-containing alkaline processing composition is arranged in the position adjacent to the top layer of the above light-sensitive layers and the transparent cover sheet. The thus prepared film unit is exposed through the transparent cover sheet thereof to light, and then, at the time of pulling the film unit out of the camera, the container is ruptured by the pressure members to thereby spread the processing composition throughout the entire area between the light-sensitive layer and the cover sheet, whereby the film unit is shielded from light and thus the development proceeds.

Other useful, multilayered, integrated film units otherwise formed suitable for use in the present invention are described in U.S. Pat. Nos. 3,415,644, 3,415,645, 3,415,646, 3,647,487 and 3,635,707, and West German OLS Patent No. 2,426,980.

The silver halide photographic light-sensitive material of the present invention enables the formation of a color positive image by the diffusion transfer onto the image receiving layer of the diffusible dye or the precursor thereof released imagewise during the development following exposure to light or also enables the formation of a color image by utilizing the dye remaining to be distributed imagewise after removing the finally unused material by the diffusion transfer. In the latter, the color image is obtained in the negative form to the original or subject.

As has been mentioned in detail above, in the novel silver halide photographic light-sensitive material of the present invention, a negative type emulsion, a compound capable of releasing a diffusible development inhibitor during the development, an internally fogged emulsion, and a DRR compound are combined to be incorporated into each of the component layers of the photographic material, so that, for example, by developing the photographic material with a developer for B/W use such as, e.g., a 3-pyrazolidinone derivative, a color positive image with a low minimum density and with no stain was able to be formed.

The silver halide photographic light-sensitive material of the present invention is illustrated in reference to examples below:

EXAMPLE 1

(a) Preparation of an internally fogged emulsion

One liter of an aqueous solution of 2.2 g of potassium bromide and 20 g of gelatin dissolved into water was stirred at 60° C., to which were then added to be mixed therein at the same time 150 ml of an aqueous solution of both potassium bromide and potassium iodide dissolved into water so that the halogen ion concentration in the solution is 3.5 mol per liter and 150 ml of an aqueous ammoniacal silver nitrate solution in the same concentration as the above, and further added 20 ml of an aqueous solution containing 10 g of silver nitrate, and after 10 minutes, to the mixture were further added potassium chloroaurate in the quantity of 1.56 mg and ammonium thiocyanate in the quantity of 71.9 mg per mol of the silver halide, and the resulting mixture was subjected to a ripening over a period of 50 minutes at 60° C.

The thus produced silver halide particles were fogged. To the resulting dispersed liquid were concurrently added 600 ml of an aqueous solution of both potassium bromide and potassium iodide dissolved into water so that the halogen ion concentration is 0.5 mol/liter and 500 ml of an aqueous silver nitrate solution in the concentration of 0.5 mol/liter, thereby preparing a fog nucleus-having internal latent image type silver halide emulsion consisting of tetradecahedral silver halide particles having the average particle diameter of 0.4 μm.

A test piece prepared by coating on a polyethylene terephthalate film support the resulting emulsion with the silver thereof in the quantity of about 3.5 g/m$^2$ was imagewise exposed to light for 1/25 second, and then developed for 6 minutes at 20° C. with the foregoing surface developer solution, but no image appeared nor fog occurred.

Further, in order to examine the level of the fog nuclei present in the above silver halide particles, the test piece was subjected to a 5-minute development at 20° C. with the use of the foregoing internal developer solution, and as a result, a transmission density of not less than 2.0 was observed.

(b) Preparation of a Photographic Light-Sensitive Material

A magenta color light-sensitive material was prepared by coating on a transparent polyethylene terephthalate film support in order the following composition-having thin layers:

(i) An image receiving layer having styrene-N-vinylbenzyl-N-benzyl N,N-dimethyl ammonium chloride-vinyl benzene copolymer (molar ratio 49:49:2)(22 mg/100 cm$^2$) and gelatin (22 mg/100 cm$^2$), (ii) a light-reflective layer having titanium dioxide (220 mg/100 cm$^2$) and gelatin (22 mg/100 cm$^2$), (iii) a black opacifying layer having carbon black (25 mg/100 cm$^2$) and gelatin (17 mg/100 cm$^2$), (iv) a layer having a magenta DRR compound (7.0 mg/100 cm$^2$), N,N-diethyl lauramide (7.0 mg/100 cm$^2$) and gelatin (17 mg/100 cm$^2$), said magenta DRR compound having the formula:

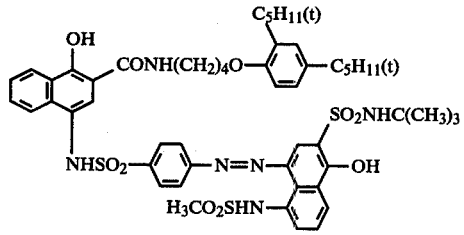

(v) an internally fogged emulsion layer consisting of the aforementioned internally fogged emulsion (silver equivalent of 14 mg/100 cm$^2$), 2,5-di-sec-dodecyl hydroquinone (1.5 mg/100 cm$^2$), dibutyl phthalate (0.5 mg/100 cm$^2$), 1-phenyl-5-mercaptotetrazole (0.06 mg/100 cm$^2$) and gelatin (17 mg/100 cm$^2$), (vi) an interlayer having gelatin (16 mg/100 cm$^2$), 2,5-di-sec-dodecyl hydroquinone (13 mg/100 cm$^2$) and dibutyl phthalate (4 mg/100 cm$^2$), (vii) a development inhibitor-releasing compound layer consisting of the foregoing compound (4)(5 mg/100 cm$^2$), N,N-diethyl lauramide (5 mg/100 cm$^2$) and gelatin (17 mg/100 cm$^2$), (viii) a green sensitive negative type emulsion layer consisting of a green-sensitive negative type silver iodobromide emulsion (silver equivalent of 15 mg/100 cm$^2$) and gelatin (17 mg/100 cm$^2$), and (ix) a protective layer consisting of tetrakis(vinyl-sulfonyl-methyl) methane (0.8 mg/100 cm$^2$), 2,5-di-tert-octyl hydroquinone (6 mg/100 cm$^2$), butyl phthalate (2 mg/100 cm$^2$) and gelatin (10.0 mg/100 cm$^2$).

In addition to the above, another light-sensitive material as control was prepared in the same manner as in (v) with the exception that the internally fogged emulsion was replaced by a silver chloroiodobromide emulsion whose particle surface is in advance given fog nuclei.

Subsequently, a cover sheet was prepared by coating on a 100 μm-thick polyethylene terephthalate film support in order the following layers:

(a) A neutralizing layer having acrylic acid-butyl acrylate copolymer (ratio by weight 70:30)(200 mg/100 cm²), and (b) a timing layer having cellulose diacetate (acetylation degree 55 mol%) (57 mg/100 cm²).

The thus prepared photographic light-sensitive materials each was exposed through an optical wedge to a minus blue light, and then the above cover sheet was superposed on the exposed surface of the light-sensitive material, and a pod containing the following composition-having alkaline processing solution was attached to therebetween to form a unit, which was then passed between a pair of juxtaposed pressure rollers to be ruptured, whereby the alkaline processing solution was spread between the exposed surface of the light-sensitive material and the timing layer of the cover sheet. The thickness of the processing liquid layer at this time was controlled so as to become 80 μm.

| Composition of the processing solution: | |
|---|---|
| Potassium hydroxide | 70.125 g |
| 4-hydroxymethyl-4-methyl-1-phenyl-3-pyrazolidone | 12.615 g |
| 5-methyl benzotriazole | 4.125 g |
| Carbon black | 160.0 g |
| Carboxymethyl cellulose sodium salt | 60.0 g |
| Anhydrous sodium sulfite | 40.0 g |
| Water | 1,000 ml |

When viewing from the image receiving layer side of the above-processed photographic light-sensitive materials, all these light sensitive materials each showed the formation of a magenta dye image corresponding to the given imagewise exposure. However, as is apparent from the following Table 1, the light-sensitive material of the present invention in which the internally fogged emulsion was used enabled the formation of a color positive image having lower minimum density than that in the case of the control light-sensitive material.

TABLE 1

| No. | Maximum density | Minimum density |
|---|---|---|
| 1 (this invention) | 1.51 | 0.13 |
| 2 (control) | 1.52 | 0.42 |

EXAMPLE 2

A light-sensitive material was prepared in the same manner as in Example 1 with the exception that the magenta DRR compound in component layer (iv) of light-sensitive material No. 1 described in Example 1 was replaced by the following DRR compound, and compound (4) used in component layer (vii) of the same light-sensitive material was replaced by compound (2). The DRR compound (magenta) used in this example has the formula:

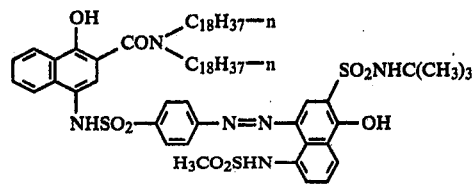

The thus prepared light-sensitive material was subjected to an exposure and development in the same manners as in Example 1, and also showed the formation of a magenta dye image. However, the minimum density obtained in this example was higher than that of light-sensitive material No. 1 (see Table 1) in Example 1. This indicates that when the relative reaction rate at the time when a diffusible development inhibitor is released from the compound having Formula (II) as a result of the oxidation and hydrolysis thereof is lower than that when the diffusible dye is released from the compound having Formula (I) as the result of the oxidation and hyrolysis thereof, the minimum density of the dye image tends to become higher. In this connection, it is known that the above relative reaction rate depends on the kind of the so-called carrier portion, there exists a relation as shown in Table 2 between the relative reaction rates of the compounds used in Examples 1 and 2.

TABLE 2

| | Relative reaction rate | |
|---|---|---|
| | DRR compound | Development inhibitor-releasing compound |
| Example 1 | lower | higher |
| Example 2 | higher | lower |

EXAMPLE 3

The following layers were coated in order on a 100 μm-thick transparent polyethylene terephthalate film support to thereby prepare a multicolor light-sensitive material:

(i) A layer having the internally fogged emulsion as described in Example 1 (silver equivalent of 17.5 mg/100 cm²), 1-phenyl-5-mercaptotetrazole (0.08 mg/100 cm²), 2,5-di-sec-dodecyl hydroquinone (1.8 mg/100 cm²), a cyan DRR compound (6.9 mg/100 cm²), N,N-diethyl lauramide (6.9 mg/100 cm²) and gelatin (17 mg/100 cm²), said DRR compound having the formula:

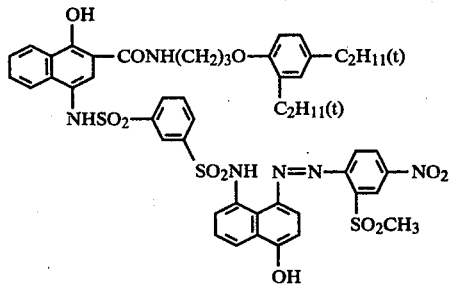

(ii) a layer having compound (4) (6.7 mg/100 cm²), N,N-diethyl lauramide (6.7 mg/100 cm²) and gelatin (17 mg/100 cm²), (iii) a light-sensitive emulsion layer having a red-sensitive negative type silver iodobromide emulsion (silver equivalent of 20 mg/100 cm$^2$) and gelatin (17 mg/100 cm$^2$), (iv) an interlayer having gelatin (16 mg/100 cm$^2$) and 2,5-di-sec-dodecyl hydroquinone (13 mg/100 cm$^2$), (v) a layer having the internally fogged emulsion as described in Example 1 (silver equivalent of 14 mg/100 cm$^2$), 1-phenyl-5-mercaptotetrazole (0.06 mg/100 cm$^2$), 2,5-di-sec-dodecyl hydroquinone (1.5 mg/100 cm$^2$), a magenta DRR compound (7.5 mg/100 cm$^2$), N,N-diethyl lauramide (7.5 mg/100 cm$^2$) and gelatin (17 mg/100 cm$^2$), said magenta DRR compound having the formula:

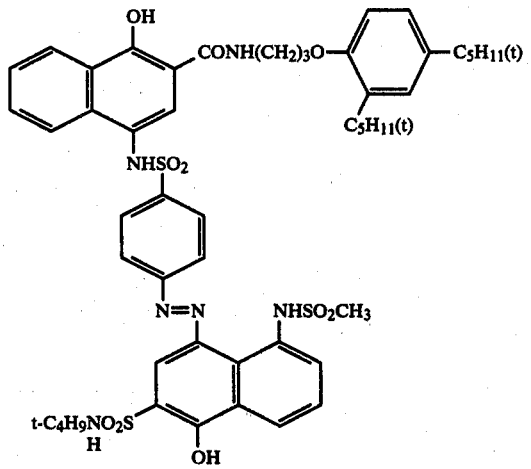

(vi) a layer having compound (4)(5.0 mg/100 cm$^2$), N,N-diethyl lauramide (5.0 mg/100 cm$^2$) and gelatin, (vii) a light-sensitive emulsion layer having a green-sensitive negative type silver iodobromide emulsion (silver equivalent of 15 mg/100 cm$^2$) and gelatin (17 mg/100 cm$^2$), (viii) an interlayer having gelatin (16 mg/100 cm$^2$) and 2,5-di-sec-dodecyl hydroquinone (13 mg/100 cm$^2$), (ix) a layer having the internally fogged emulsion as described in Example 1 (silver equivalent of 14 mg/100 cm$^2$), 1-phenyl-5-mercaptotetrazole (0.06 mg/100 cm$^2$), 2,5-di-sec-dodecyl hydroquinone (1.5 mg/100 cm$^2$), an yellow DRR compound (8.5 mg/100 cm$^2$), N,N-diethyl lauramide (8.5 mg/100 cm$^2$) and gelatin (17 mg/100 cm$^2$), said yellow DRR compound having the formula:

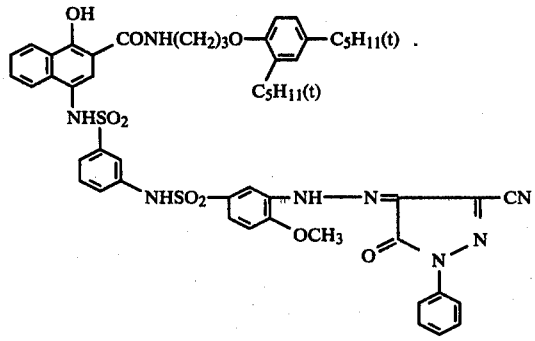

(x) a layer having compound (4)(5.0 mg/100 cm$^2$), N,N-diethyl lauramide (5.0 mg/100 cm$^2$) and gelatin, (xi) a light-sensitive emulsion layer having a blue-sensitive negative type silver iodobromide emulsion (silver equivalent of 15 mg/100 cm$^2$) and gelatin (17 mg/100 cm$^2$), and (xii) a protective layer having gelatin (10 mg/100 cm$^2$).

In addition to the above-prepared light-sensitive material of the present invention, another light-sensitive layer as control was prepared in the same manner as in above with the exception that the respective internally fogged emulsions in the above component layers (i), (v) and (ix) were replaced by a silver chloroiodobromide emulsion whose particle surface is in advance given fog nuclei. The adding amount of the emulsion in the latter was adjusted at this time so as to be the same as that of the internally fogged emulsion in each of the above-mentioned component layers.

Each of the two different light-sensitive materials was exposed through an optical wedge to light and then immersed in the following developer solution for 30 seconds at 20° C.:

| Developer solution: | |
|---|---|
| Potassium hydroxide | 70.1 g |
| 4-hydroxymethyl-4-methyl-1-phenyl-3-pyrazolidone | 12.615 g |
| 5-methyl benzotriazole | 7.2 g |
| Anhydrous sodium sulfite | 35.0 g |
| Water to make 1 liter | |

These light-sensitive materials each was subsequently superposed upon and brought into close contact with the image receiving sheet. Five minutes layer, the two were peeled apart from each other, and the image receiving sheet was washed and then dried. This image receiving sheet was composed of a polyethylene-coated paper support and the following layers coated in order thereon:

(a) an image receiving layer having an acid-treated gelatin (22 mg/100 cm$^2$) and copoly(styrene-co-N-vinyl-benzyl-N-benzyl-N,N-dimethyl ammonium chloride-co-divinyl benzene)(molar ratio 49:49:2)(22 mg/100 cm$^2$), and (b) a protective layer having gelatin (10 mg/100 cm$^2$).

The maximum densities and the minimum densities of the obtained multicolor dye positive image are shown in Table 3. As apparent from the table, the light-sensitive material of the present invention in which the internally fogged emulsion was used shows much lower minimum densities than those of the control light-sensitive material.

TABLE 3

| | Sample | Maximum density | Minimum density |
|---|---|---|---|
| This invention | yellow image | 1.68 | 0.12 |
| | magenta image | 1.75 | 0.13 |
| | cyan image | 1.72 | 0.12 |
| Control | yellow image | 1.66 | 0.38 |
| | magenta image | 1.77 | 0.41 |
| | cyan image | 1.73 | 0.40 |

What is claimed is:

1. A silver halide photographic light-sensitive material comprising:

a support;

a combination of an unfogged surface latent image type silver halide photographic emulsion and a first material which is non-diffusible under alkaline conditions and which is capable of releasing a diffusible development inhibitor or a precursor thereof as a result of cross oxidation with an oxidized product of a photographic developing agent; and a combination of an internal latent image type silver halide photographic emulsion whose silver halide grains contain therein, prior to development, fog nuclei and a dye image-forming material which is initially non-diffusible under alkaline conditions but which is capable of releasing a diffusible dye or a precursor thereof as a result of being oxidized by the oxidized product of said photographic developing agent.

2. The silver halide photographic light-sensitive material of claim 1, wherein the unfogged surface latent image type silver halide photographic emulsion and said first material are present in the same layer of said photographic light-sensitive material.

3. The silver halide photographic light-sensitive material of claim 1, wherein the unfogged surface latent image type silver halide photographic emulsion and said first material are present in different layers of said photographic light-sensitive material.

4. The silver halide photographic light-sensitive material of claim 1, 2, or 3, wherein the internal latent image type silver halide photographic emulsion and the dye image-forming material capable of releasing a diffusible dye or the precursor thereof are present in the same layer.

5. The silver halide photographic light-sensitve material of claim 1, 2 or 3, wherein the internal latent image type silver halide photographic emulsion and the dye image-forming material are present in different layers.

6. The silver halide photographic light-sensitive material according to claim 2 or 3, further comprising an interlayer.

7. The silver halide photographic light-sensitive material according to claim 4 further comprising an interlayer.

8. The silver halide photographic light-sensitive material according to claim 5 further comprising an interlayer.

9. The silver halide photographic light-sensitive material of claim 1, wherein the internal latent image type silver halide emulsion is such that a test piece coated with said emulsion and exposed to light for 1/100 to 1 second, when processed in an internally developing solution at 20° C. for 5 minutes, has a maximum density which exceeds at least 10 times the maximum density of the same test piece when processed in a surface developing solution at 20° C. for 6 minutes.

10. The silver halide photographic light-sensitive material of claim 1, wherein the internal latent image type silver halide emulsion is such that the transmission density of a test piece prepared by coating said emulsion having an amount of silver equivalent of 3.5 to 4.5 g/m$^2$ on a transparent support, when processed in an internally developing solution at 20° C. for 5 minutes, is at least 0.50.

11. The silver halide photographic light-sensitive material of claim 1, wherein the internal latent image type silver halide emulsion comprises a core of silver halide grains having fog nuclei on the surface thereof, said core of silver halide grains being covered with an unfogged silver halide.

12. The silver halide photographic light-sensitive material of claim 1, wherein the internal latent image type silver halide emulsion consists essentially of grains of silver chloride.

13. The silver halide photographic light-sensitive material of claim 1, wherein the internal latent image type silver halide emulsion consists essentially of grains of silver bromide.

14. The silver halide photographic light-sensitive material of claim 1, wherein said dye-image forming material is a compound selected from those represented by Formula (1)

Formula (1)

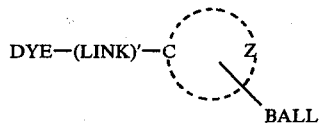

wherein (LINK)' is selected from the group consisting of —O—, —S—, —$SO_2$— and —$SO_2NH$— wherein the nitrogen atom is attached to

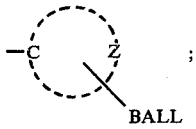

;

Z is a group of nonmetallic atoms necessary to form a 5- or 6-member ring together with the carbon atom bonding to the (LINK)', said bonding with the (LINK)' being cleavable as a result of the reaction with the oxide of a silver halide developing agent under alkaline conditions; DYE is a diffusible dye group or dye precursor group; BALL is a photographically inert ballast group having a molecular size and conformation sufficient to render said dye image forming material non-diffusible under alkaline conditions.

15. The silver halide photographic light-sensitive material of claim 14, wherein said

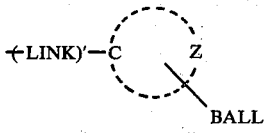

is selected from compounds represented by Formula (Ia)

Formula (Ia)

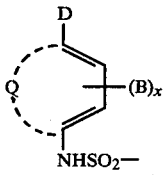

wherein Q is a group of nonmetallic atoms necessary to form a substituted or unsubstituted 6-member aromatic ring; B is selected from the group consisting of hydrogen, halogen, sulfo, a carboxyl group, an alkyl group, an aryl group, an alkoxy group, an aryloxy group, nitro, amino, cyano, an alkylamino group, an arylamino group, an alkylthio group and a heterocyclic group which is coupled directly to said 6-member aromatic ring or through a member selected from the group consisting of

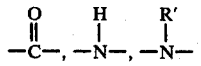

(wherein R′ is an alkyl group), a straight or branched chain alkylene group, —O—, —S—, —$SO_2$—, a phenylene group, a phenylene group substituted with an alkyl group, and a group formed by the combination of any of said groups with said 6-member aromatic ring; D is a group represented by —$OR^{(1)}$ or —$NHR^{(2)}$ wherein $R^{(1)}$ is hydrogen or a group cleavable from the oxygen atom when said alkaline condition is characterized by a hydrogen ion concentration of between $10^{-5}$ to 2 mol/-liter; $R^{(2)}$ is hydrogen or an alkyl group; X is an integer of 1, 2 or 3 and when X is 2 or 3, B may be the same group or groups different from one another; and the total number of the carbon atoms of the alkyl groups represented by $R^{(2)}$ and (B)x is at least 8.

16. The silver halide photographic light-sensitive material of claim 15 wherein said compounds are selected from the group consisting of

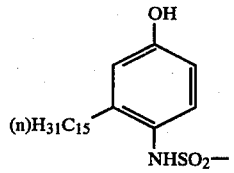

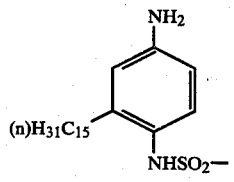

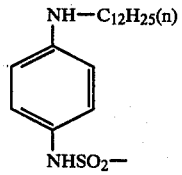

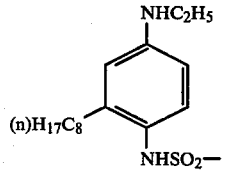

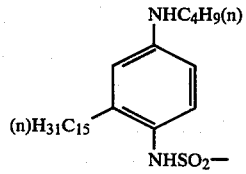

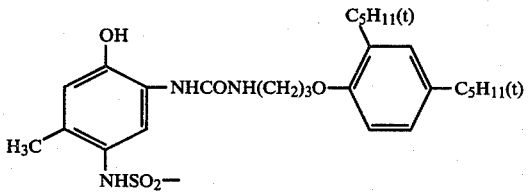

-continued

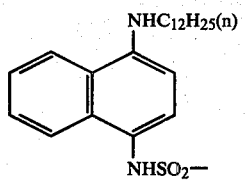

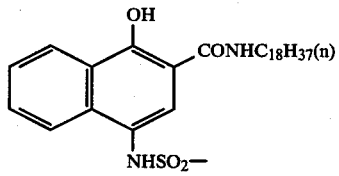

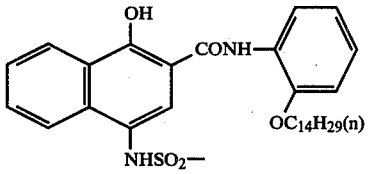

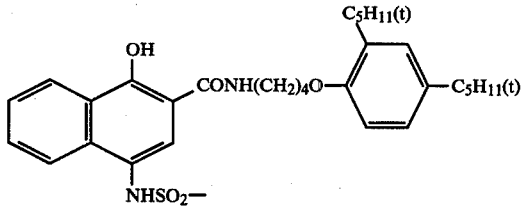

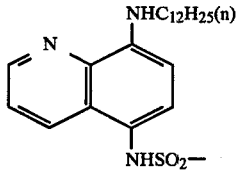

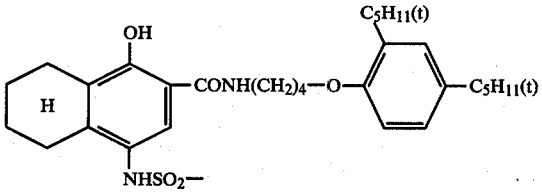

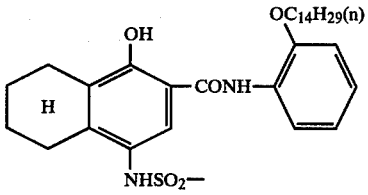

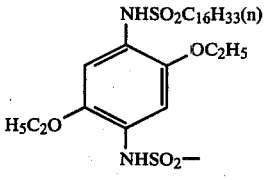

-continued

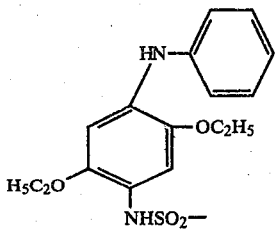

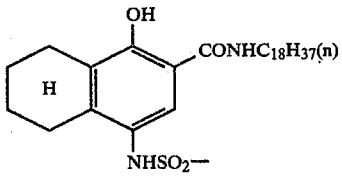

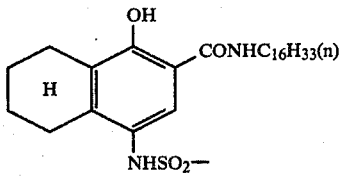

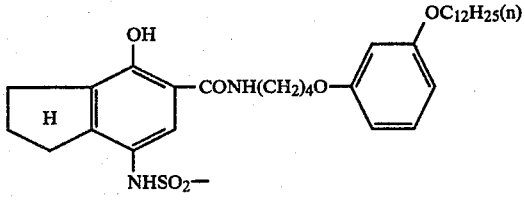

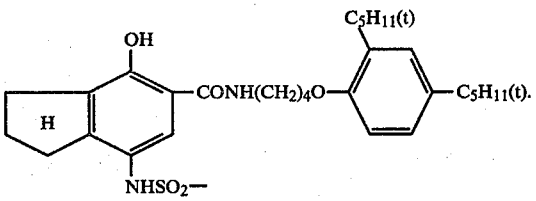

17. The silver halide photographic light-sensitive material of claim 14, wherein said

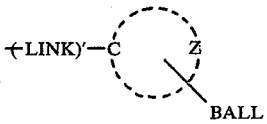

is selected from compounds represented by Formula (Ib)

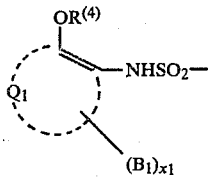

Formula (Ib)

wherein $Q_1$ is a group of nonmetallic atoms necessary to form a substituted or unsubstituted 6-member aromatic ring; $B_1$ is selected from the group consisting of hydrogen, halogen, sulfo, a carboxyl group, an alkyl group, an aryl group, an alkoxy group, an aryloxy group, nitro, amino, cyano, an alkylamino group, an arylamino group, an alkylthio group and a heterocyclic group which is coupled directly to said 6-member aromatic ring or through a member selected from the group consisting of

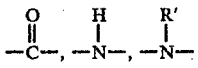

(wherein R' is an alkyl group), a straight or branched chain alkylene group, —O—, —S—, —$SO_2$—, a phenylene group, a phenylene group substituted with an alkyl group, and a group formed by the combination of any of said groups with said 6-member aromatic ring; $R^{(4)}$ is hydrogen or a group cleavable from the oxygen atom when said alkaline condition is characterized by a hydrogen ion concentration of between $10^{-5}$ to 2 mol/liter; $X_1$ is an integer of 1, 2 or 3 and when $X_1$ is 2 or 3, $B_1$ may be the same group or groups different from one another; and the total number of the carbon atoms of the alkyl groups represented by $(B_1)x_1$ is at least 8.

18. The silver halide photographic light-sensitive material of claim 14, wherein said

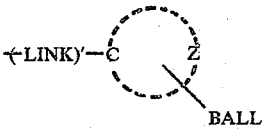

is selected from compounds represented Formula (Ic):

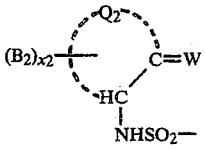

Formula (Ic)

wherein W is oxygen or =$NR^{(5)}$, wherein $R^{(5)}$ is a hydroxyl group or an amino group; $Q_2$ is a group of nonmetallic atoms necessary to form a saturated or unsaturated 5- or 6-member nonaromatic hydrocarbon ring together with the carbon atom; $B_2$ is selected from the group consisting of hydrogen, halogen, sulfo, a carboxyl group, an alkyl group, an aryl group, an alkoxy group, an aryloxy group, nitro, amino, cyano, an alkylamino group, an arylamino group, an alkylthio group and a heterocyclic group which is coupled directly to said 6-member aromatic ring or through a member selected from the group consisting of

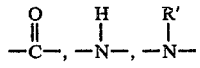

(wherein R' is an alkyl group), a straight or branched chain alkylene group, —O—, —S—, —$SO_2$—, a phenylene group, a phenylene group substituted with an alkyl group, and a group formed by the combination of any of said groups with said 6-member aromatic ring; and $X_2$ is an integer of 1, 2 or 3 and when $X_2$ is 2 or 3, $B_2$ may be the same group or groups different from one another; and the total number of carbon atoms of the alkyl groups represented by $(B_2)x_2$ is at least 8.

19. The silver halide hotograhic light-sensitive material of claim 14, wherein said

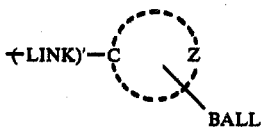

is selected from compounds represented for Formula (Id):

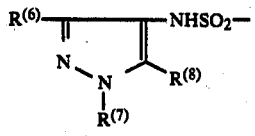

Formula (Id)

wherein ($R^6$) is selected from the group consisting of an alkyl group, an acylamino group and an arylamino group; $R^{(7)}$ is selected from the group consisting of an alkyl group, an aryl group, an acyl group, and a heterocyclic group; $R^{(8)}$ is —$Or^{(9)}$ wherein $R^{(9)}$ is hydrogen or a group cleavable from the oxygen atom when said alkaline condition is characterized by hydrogen ion concentration of between $10^{-5}$ to 2 mol/liter; or —$NR^{(10)}R^{(11)}$ wherein $R^{(10)}$ and $R^{(11)}$ are each selected from the group consisting of hydrogen, an alkyl group, an aryl group, a heterocyclic group and an acyl group, and $R^{(10)}$ and $R^{(11)}$ may form a 5- or 6-member heterocyclic ring containing at least one oxygen atom or nitrogen atom together with $R^{(7)}$.

20. The silver halide photographic light-sensitive material of claim 14 wherein said

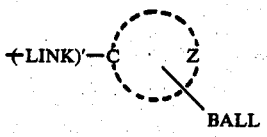

is selected from compounds represented by Formula (Ie):

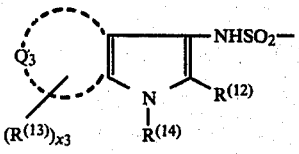

Formula (Ie)

wherein $Q_3$ is a group of nonmetallic atoms necessary to form a 5- or 6-member rign; $R^{(12)}$ is selected from the group consisting of hydrogen, a halogen, hydroxyl, cyano, amino, an alkyl group, an aryl group, an acyl group, a carbamoyl group, a carbonamide group, an alkoxycarbamoyl group and a heterocyclic group; $R^{(13)}$ is selected from the group consisting of hydrogen, a halogen, hydroxyl, cyano, sulfo, carboxyl, an alkyl group, an aryl group, an alkoxy group, an acyl group, amino, a carbonamide group and an acyloxy group; $R^{(14)}$ is selected from the group consisting of hydrogen, an alkyl group, an aryl group, and a heterocyclic group; $X_3$ is an integer of from 1 to 4 and when $X_3$ is from 2 to 4, the members of $R^{(13)}$ each may be the same or different from one another; $R^{(14)}$ may form a 5- or 6-member heterocyclic ring together with at least one selected from $R^{(12)}$ and $R^{(13)}$; and the total number of the carbon atoms of $R^{(12)}$, $R^{(13)}$ and $R^{(14)}$ is at least 8.

21. The silver halide photographic light-sensitive material according to claim 1, wherein said first material is selected from compounds represented by Formula (II):

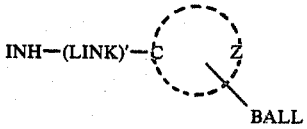

Formula (II)

wherein INH represents a development inhibitor or the precursor thereof; and wherein (LINK)′ is selected from the group consisting of —O—, —S—, —$SO_2$— and —$SO_2NH$— wherein the nitrogen atom is attached to

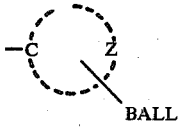

;

Z is a group of nonmetallic atoms necessary to form a 5- or 6-member ring together with the carbon atom bonding to the (LINK)′, said bonding with the (LINK)′ being cleavable as a result of the reaction with the oxide of a silver halide developing agent; BALL is a photographically inert ballast group having a molecular size and conformation sufficient to render said dye image forming material non-diffusible under alkaline conditions.

22. The silver halide photographic light-sensitive material of claim 1, wherein the relative reaction rate at the time when said diffusible development inhibitor or the precursor thereof from said first material as the result of the oxidation or hydrolysis thereof is not lower than the relative reaction rate when the diffusible dye or the precursor thereof is released from the image-forming material as the result of the oxidation or hydrolysis thereof.

* * * * *